US005251854A

United States Patent [19]

Iwamoto

[11] Patent Number: 5,251,854

[45] Date of Patent: Oct. 12, 1993

[54] TWO-SAILED SPORT KITE

[76] Inventor: Tomoyo Iwamoto, 25165 Stewart Pl., Carmel, Calif. 93923

[21] Appl. No.: 940,307

[22] Filed: Sep. 3, 1992

[51] Int. Cl.[5] ..... A63H 27/08; B64C 31/06

[52] U.S. Cl. ..... 244/153 R; 244/155 A

[58] Field of Search ..... 244/153 R, 155 A, 901, 244/904, 152

[56] References Cited

U.S. PATENT DOCUMENTS

| | | | |
|---|---|---|---|
| 606,960 | 7/1898 | Doyle | 244/153 R |
| 2,931,600 | 4/1960 | Riker | 244/153 |
| 3,951,363 | 4/1976 | Grauel | 244/153 R |
| 4,807,832 | 2/1989 | Tabor | 244/153 R |
| 4,874,146 | 10/1989 | Heid | 244/153 R |
| 4,981,273 | 1/1991 | Petteys | 244/155 A |

*Primary Examiner*—David A. Bucci
*Assistant Examiner*—Virna Lissi Ansley
*Attorney, Agent, or Firm*—Jeffrey A. Hall

[57] ABSTRACT

A two-sailed delta-shaped sport kite for sailing under variable wind conditions having a frame comprising a central rod having a first and a second side secured to a pair of diagonal frame members, a first perpendicular rod and a second perpendicular rod are secured to the central rod and have batten rods secured thereto. A first and a second sail of durable, flexible, resilient material are secured to the frame. The second sail is positioned in back of the first sail and is secured to the rear side of the central rod to channel air flow behind the first sail to allow for turns of extremely small radius while providing stability in both high and low winds.

2 Claims, 9 Drawing Sheets

TWO-SAILED SPORT KITE

BACKGROUND OF THE INVENTION

1. Field of Invention

This invention relates to kites, and more particularly to two-string kites used for sport, entertainment, and competition.

2. Description of Prior Art

Numerous kites and flying apparatuses have been proposed and developed for sport, entertainment, competition, and the like. Since ancient times kite flying has been a popular pastime for many and a wide variety of different kites have been and are currently available for use and enjoyment. Subject to the design of the kite and the materials used for the frame and sail, a kite may be flown under a wide range of conditions and maneuvered to achieve a wide range of aerial feats.

Broadly defined, kites fall into two categories: those flown with a single string or those flown with a double string. Representative examples of single-string kites include the Chinese Kite, the Malay kite, the Indian fighter kite, and the like. Two-string kites are available in a wide variety of shapes, sizes, and designs. Two strings of equal length are attached to each side of the kite and by pulling on either of the strings, the user can control and maneuver the kite. The greater maneuverability of two string kites is a result of tension adjustments on the strings. If tension is applied to the right hand string the kite moves to the right; if applied to the left hand string the kite moves to the left; and if tension is applied continuously on one string the kite will turn continuously in that direction. Most of the two-string kites presently available are diamond or delta shaped kites. The potential of a kite is determined by many factors such as controllability, strength, speed, maneuverability, and the like. Numerous attempts to improve such characteristics have been made involving different sail and frame configurations, use of different materials, different sail to frame rations, and the like. However, regardless of the modifications all known prior art kites exhibit several undesirable characteristics which limit the conditions under which they can be flown or the aerial feats and maneuvers they are capable of performing. First, it is generally difficult to fine tune or adjust a kite for a particular wind condition. Second, most kites experience certain sail and rod failure under strong wind conditions, because the wind pressure on the kite gets so high that the sail cloth and the rods of the frame warp. Third, inefficiencies occur often in wind speed of from ten to twenty five miles per hour requiring adjusting the point of attachment of the string to the kite, which of course is a serious obstacle in competition. Fourth, under strong wind conditions warpage in the sail cloth or rods make the kite move in unpredictable ways making it very hard to fly in straight lines, smooth curved lines, or performing accurate snap turns. Fifth, most two-string kites cannot perform adequately in wind speeds above twenty five miles per hour. Finally, although it is possible to design kites to perform better in strong wind conditions by making the kite smaller, having a smaller aspect ration, and the like, such configurations do not fly well under low speed wind conditions.

SUMMARY OF THE INVENTION

The present invention is a two-sail, two-string kite that is easy to assembly and manufacture, highly maneuverable in both high and low speed winds, may be tuned without adjusting the angle of flight but rather by controlling the amount and direction of air flow that the smaller sail creates, and allows for very straight and stable flight if desired yet may turn turns of extremely small radius under all wind conditions.

In accordance with the present invention there is provided, in one embodiment, a two string sport kite, comprising: a delta-shaped frame having a central rod detachably secured to a pair of diagonal frame members, said central rod having a front side and a rear side, a first and a second perpendicular rod each secured to said central rod and including batten means operably secured thereto, a first sail of durable, flexible and resilient material secured to said frame, said first sail having a tail section and a wing tip section, and a second sail positioned in back of said first sail by attachment to said rear side of said central rod.

In another embodiment, a sports kite for flying in variable winds comprises a substantially delta-shaped frame including a central rod secured to a pair of diagonal frame members, said central rod having a front side and a rear side, a first perpendicular rod and a second perpendicular rod secured to said central rod each having batten means secured thereto, a first sail of flexible durable material secured to said frame having a tail section and a wing tip section, and a second sail positioned in back of said first sail and secured to said rear side of said central rod by connecting means.

The two-string, two-sailed kite of the present invention provides a very fast, dynamic kite which is extremely stable in both high and low speed winds, which is highly maneuverable under a wide range of conditions, and which is easy to assemble and disassemble.

Additional objects and advantages of the invention will be set forth in the description which follows, and in part will be obvious from the description, or may be learned by practice of the invention. The objects and advantages of the invention may be realized and obtained by means of instrumentalities and combinations particularly pointed out in the appended claims.

BRIEF DESCRIPTION OF THE DRAWINGS

The accompanying drawings, which are incorporated in and constitute a part of the specification, illustrate a preferred embodiment of the invention, and, together with a general description given above and the detailed description given below, serve to explain the principles of the invention.

DETAILED DESCRIPTION OF THE PREFERRED EMBODIMENT OF THE INVENTION

Reference will now be made in detail to the present preferred embodiments of the invention as illustrated in the accompanying drawings.

In accordance with the present invention there is provided a two-stringed kite, comprising: a delta-shaped frame having a central rod detachably secured to a pair of diagonal frame members, said central rod having a front side and a rear side, a first and a second perpendicular rod each secured to said central rod and including batten means operably secured thereto, a first sail of durable, flexible, and resilient material secured to said frame, said first sail having a tail section and a wing tip section, and a second sail positioned in back of said first sail by attachment to said rear side of said central rod.

Figure 1:
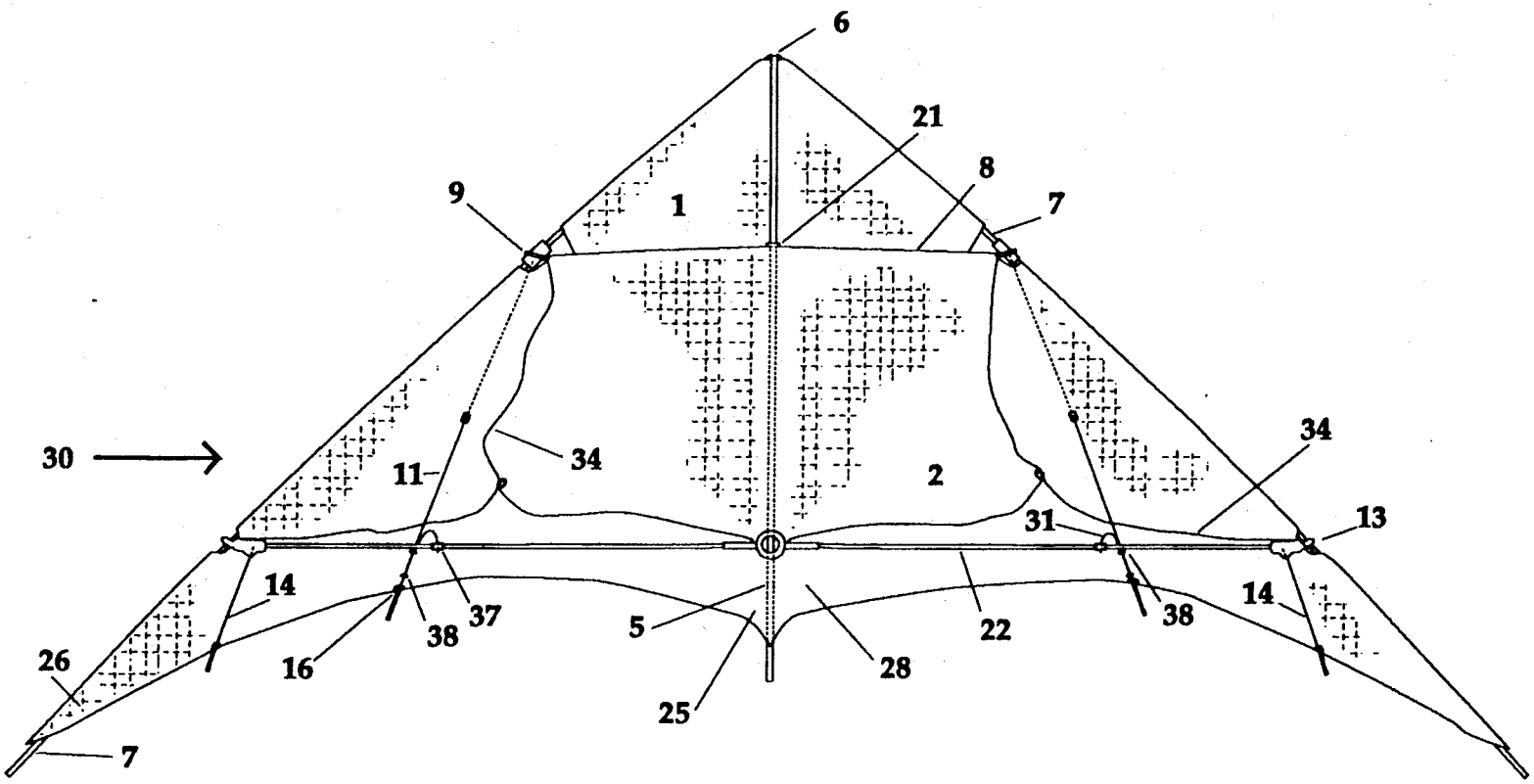
FIG. 1 shows a front view of a two-sailed sport kite, according to the invention.

In FIG. 1 the kite 30 for flying in variable winds is is shown having a substantially delta-shaped frame composed of a lightweight and durable material such as carbon graphite, or the like, and includes a tubular central rod 5, having a front side 28 and a rear side 27, is secured to a pair of tubular diagonal frame members 7. A first tubular perpendicular rod 8 and a second tubular perpendicular rod 22 are secured to central rod 5 with batten rods 11 and 14 detachably secured thereto. A first sail 2 is preferably composed of a durable, flexible, resilient material, such as rip stop nylon, or the like, and is secured to diagonal rods 7, central rod 5 and perpendicular rods 8 and 11. The first sail preferably is configured with tail section 25, and wing tip 26 best seen in FIGS. 1 and 2. A second sail 1 is positioned in front of first sail 2 and is secured to rear side 27 of central rod 5. Preferably second sail 1 is smaller than sail 2 and is positioned on central rod 5 so that when air hits this area from the side as a result of turning kite 30, the flow of air flows behind first sail 2 as a result of such positioning of second sail 1. Such channeling of air flow over first sail 1 greatly facilitates clean small turn performance by kite 30. A standoff rod 31, with fittings 37 and 38 is preferably a thin tubular flexible secured between second perpendicular rod 22 and batten rod 11 so that sail 2 is always tensioned in flight. By sliding standoff rod 31 with fittings 38 on batten rod 11, numerous unique flight characteristics of kite 30 may be obtained as well as speed control. If fittings 38 and standoff rod 31 are moved towards the nose of the kite, the shape of the batten rod and the sail will curve more, making the kite slow down in flight. Such speed control is highly desirable for team flights as well as individual sport. Fittings 37 and 38 are preferably composed of plastic, aluminum, or other lightweight, durable material.

Figure 2:
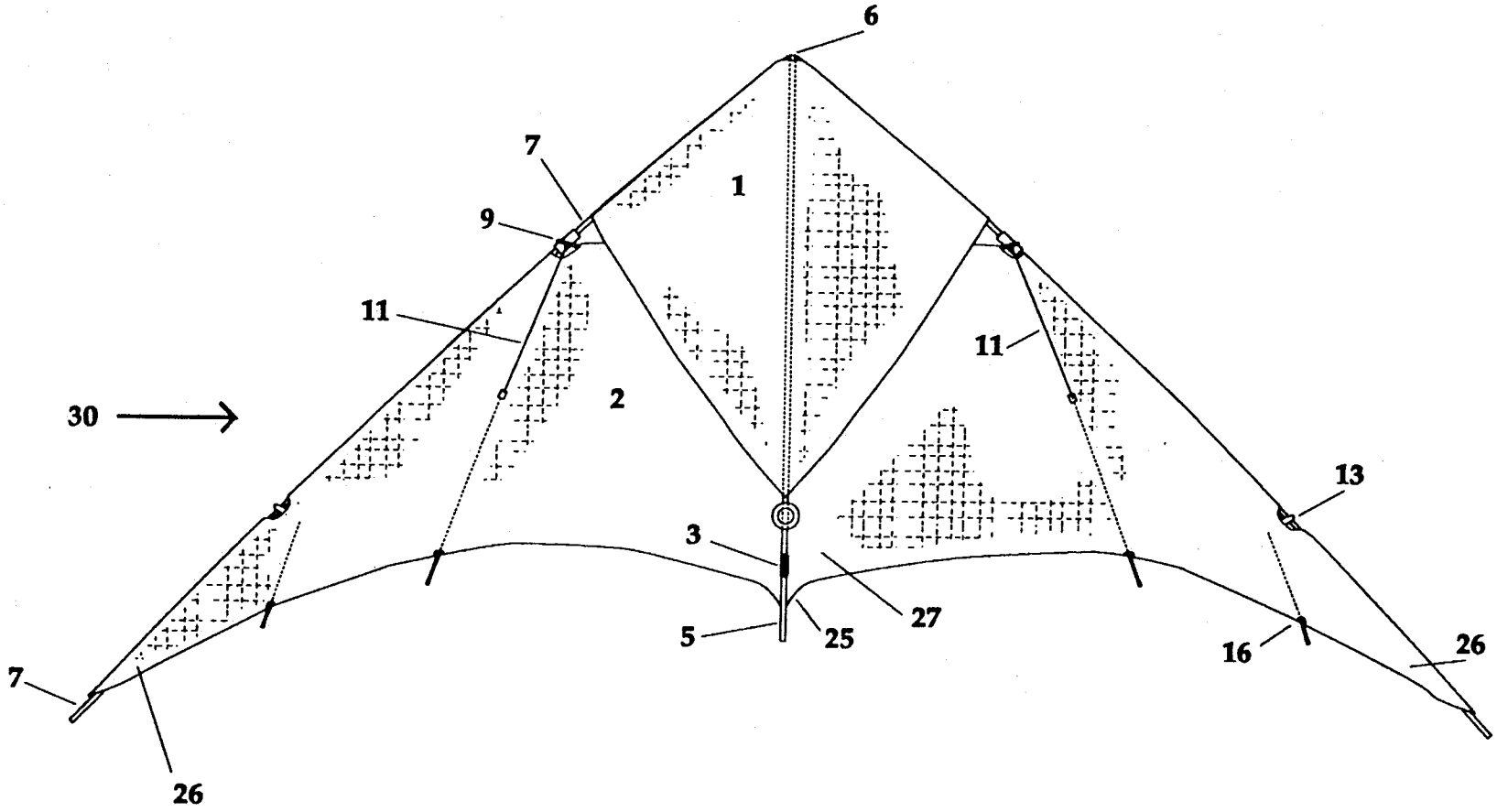
FIG. 2 is a back view of such kite, according to the invention.

As shown in FIGS. 1 and 2, kite 30 includes batten means which in this embodiment comprises a plurality of batten rods, preferably four, shown as batten rods 11 and 14. Batten rods 14, which are preferably composed of carbon rod or fiberglass, are inserted into connector 13 which connects the second perpendicular rod 22 with diagonal rod 7. Batten rods 11 are secured within a connector, preferably in tube 10 which is attached to connector 9 so that batten rod 11 is positioned and secured therein.

Figure 5:
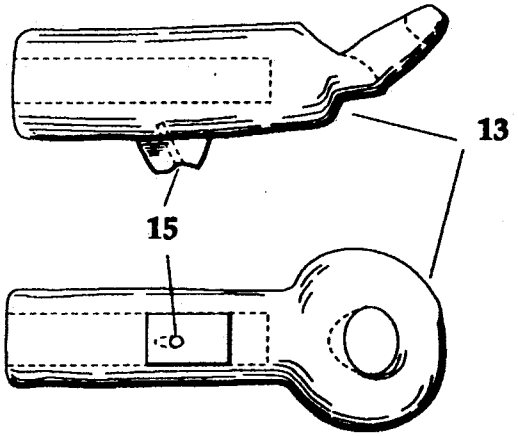
FIG. 5 shows a detail of connector 13 of such kite, according to the invention.
Figure 5A:
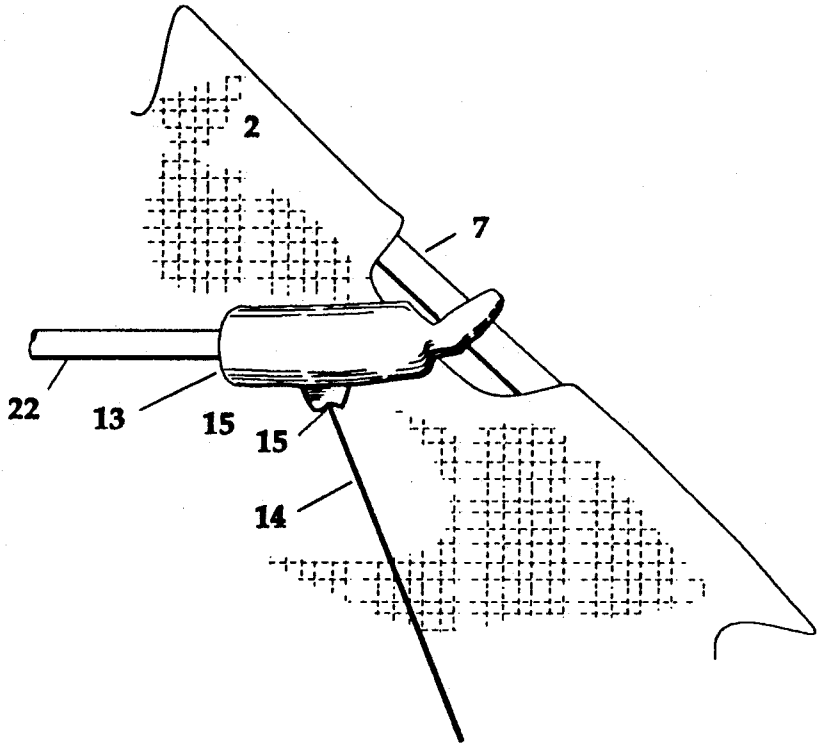
FIG. 5A shows a detail of batten rod aperture 15 of connector 13, according to the invention.
Figure 6A:
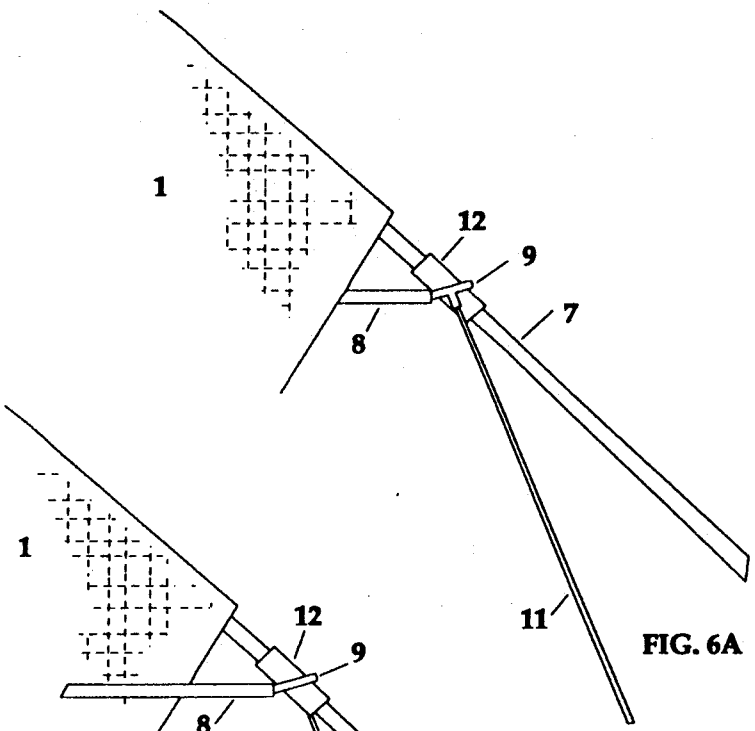
FIG. 6A shows a detail view of connector 9 (left side), according to the invention.
Figure 6:
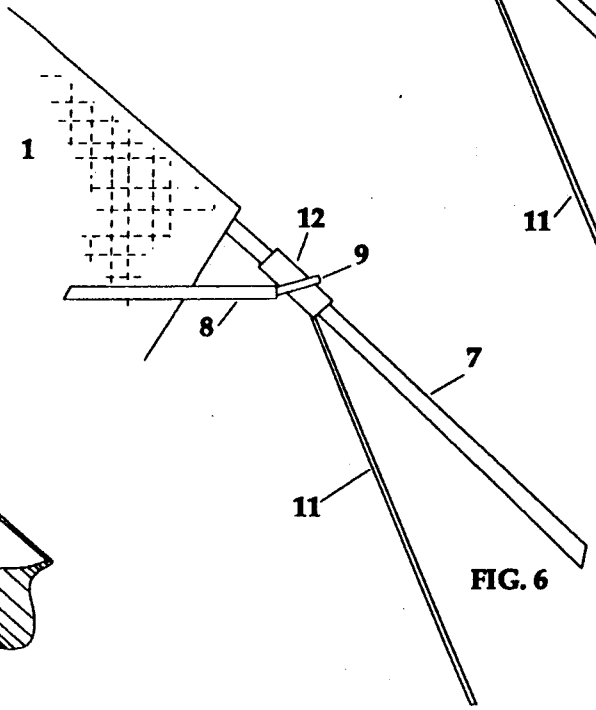
FIG. 6 shows a detail view of connector 9 (right side), according to the invention.
Figure 6B:
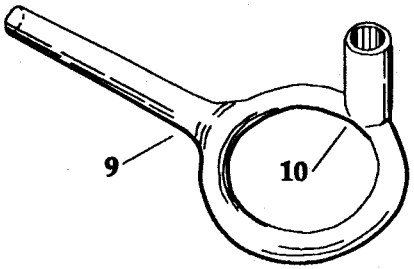
FIG. 6B shows the tube 10 to secure batten rod 11, according to the invention.
Figure 6C:
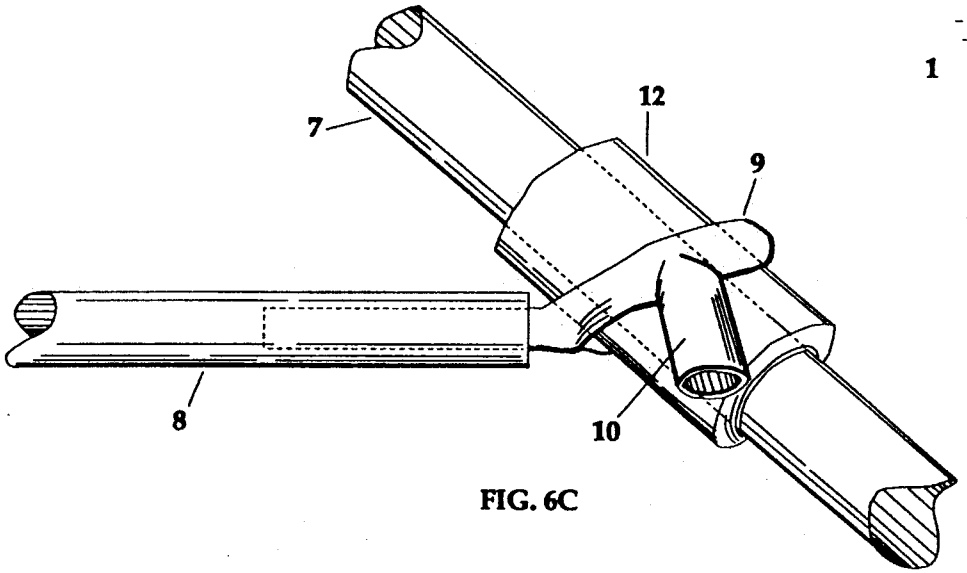
FIG. 6C shows tube 10 and connector 9 secured to diagonal rod 7, according to the invention.

Referring now to FIG. 5, a detail of connector 13 connecting second perpendicular rod 22 with diagonal rod 7 is illustrated. Connector 13 is preferably composed of a lightweight, durable, resilient material such as aluminum or plastic. Batten rod 14 is inserted into aperture 15 positioned on substantially the bottom of connector 13.

Figure 3:
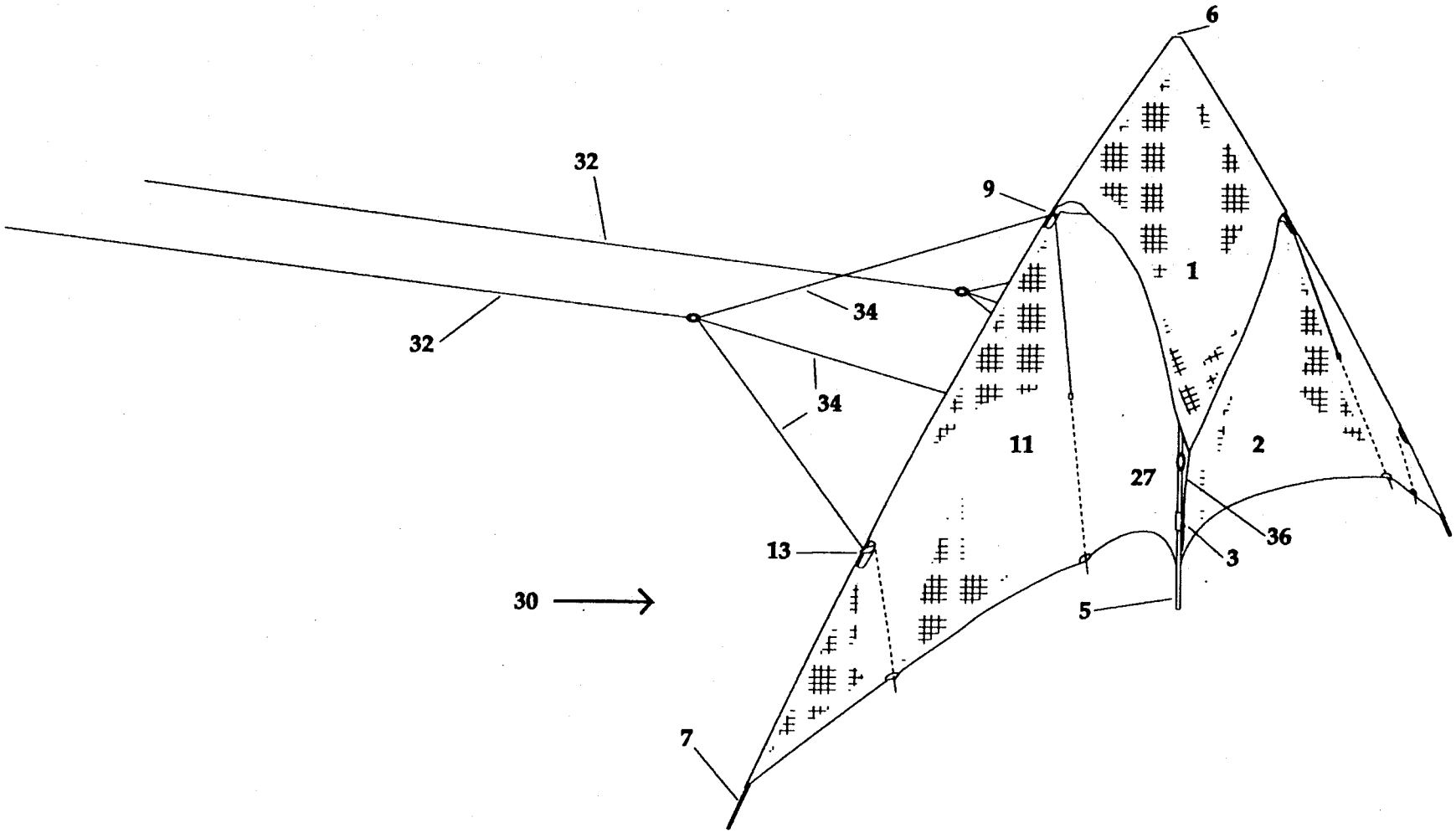
FIG. 3 shows a back perspective view of such kite having strings attached, according to the invention.
Figure 7:
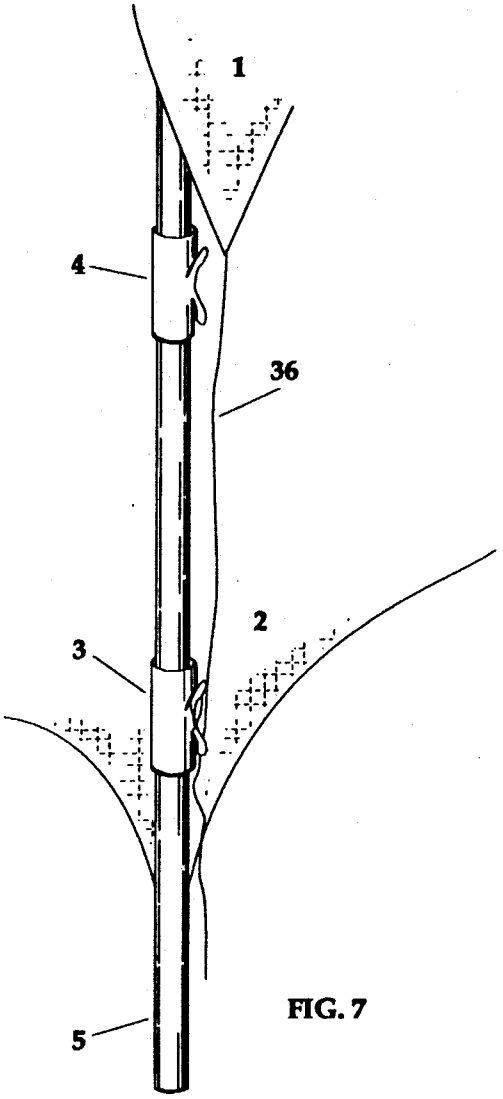
FIG. 7 shows control apparatus for second sail 1, with holder 3 and 4 on central rod 5, according to the invention.

FIG. 3 shows kite 30 with flight lines 32. Bridle lines 34, three in the preferred embodiment, are attached to connectors 13 and 9, and to spine 5 where lower perpendicular rod 22 is secured. Lines 32 are secured to the bridle lines 34, and, by adjusting the position where the bridle lines are secured to the flight lines, by either movement in the vertical or horizontal direction, the user may fine tune or adjust for a particular wind condition. Control lines 36 are secured to holder 3 or 4 having control string fastening means which may be projections, tie downs, or the like, and are secured on central rod 5 for positioning the second sail 1. Holders 3 and 4 and control lines 36 are also illustrated in FIG. 7. By providing means to control and position sail 1 the amount and direction of air flow that is channeled by sail 1 onto said 2 is manipulated.

Figure 4:
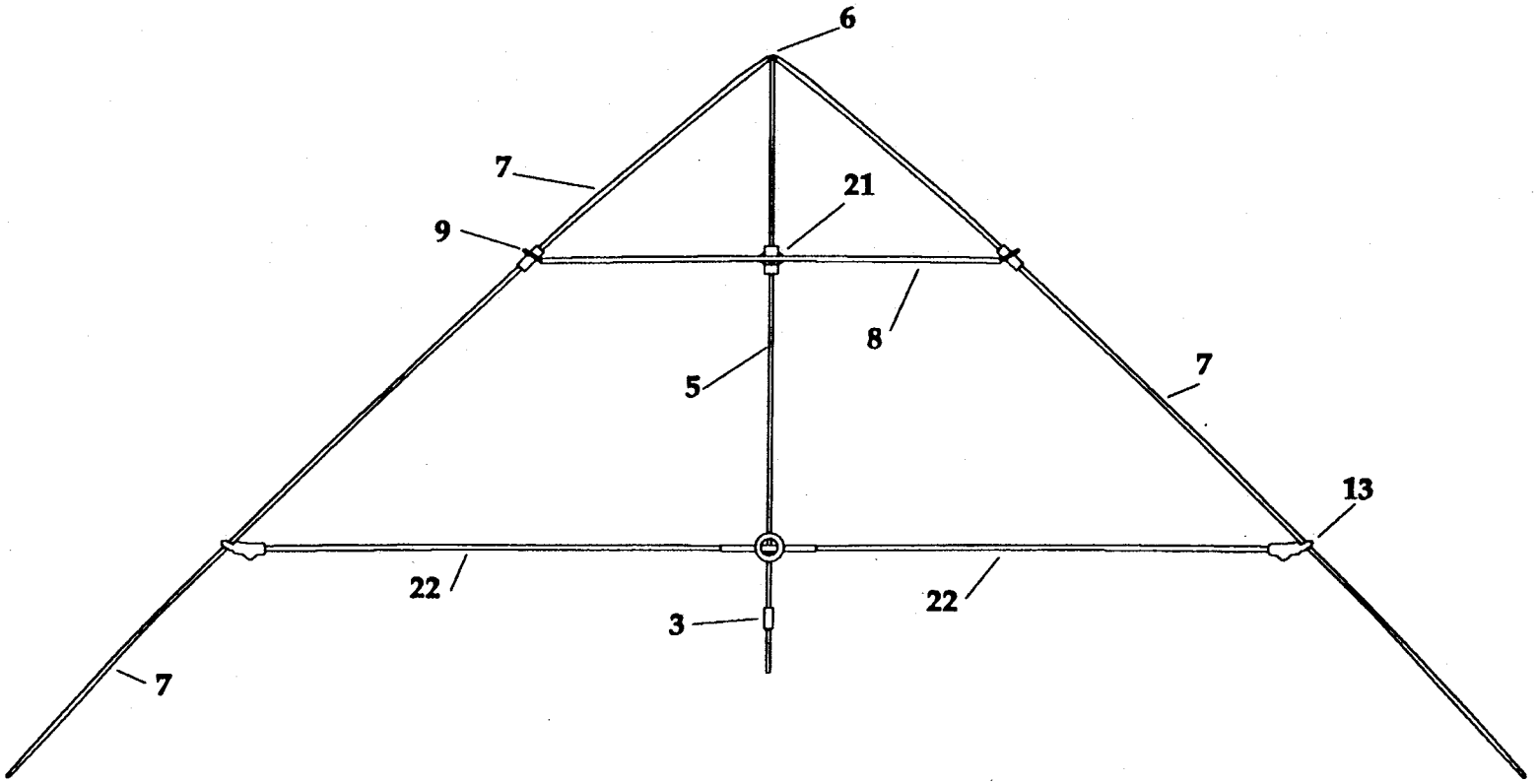
FIG. 4 shows the frame of such kite, according to the invention.

With specific reference now to FIG. 4, the attachments and preferred configuration of the frame of kite 30 is shown. Diagonal rods 7 are secured to central rod 5 at nose 6 and by the two perpendicular rods 8 and 22. Perpendicular rod 8 is secured to diagonal rod 7 by connector 9 while perpendicular rod 22 is secured by connector 13 to rod 7. Lines 32 are secured to bridle lines 34, which are preferably secured to diagonal rod 7 and to central rod 5.

As will be seen in FIGS. 6, 6A, 6B, and 6C, first tubular perpendicular rod 8 is secured diagonal rod 7 with connector 9. Connector 9 is preferably made of a lightweight, strong material such as aluminum, brass, composite, or the like, and is inserted into both ends of first tubular perpendicular rod 8. Diagonal rod 7 is inserted into a ring 10 of connector 9. A tube member 10 adapted to secure and receive batten rod 11 is secured to connector 9. Diagonal rod 7 is preferably protected from abrasion from connector 9 by cushion 12 shown in FIGS. 6, 6A, and 6C, and is preferably composed of foam, vinyl, rubber, or the like.

Figure 8:
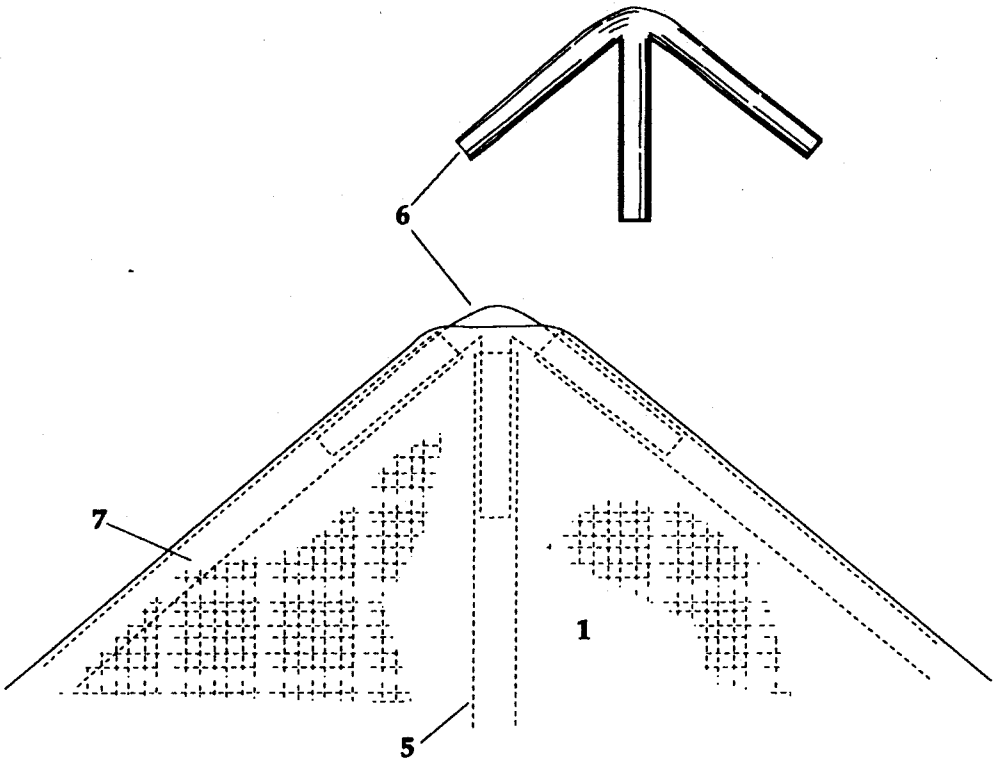
FIG. 8 shows shows a detail view of nose 6 of such kite, according to the invention.
Figure 9:
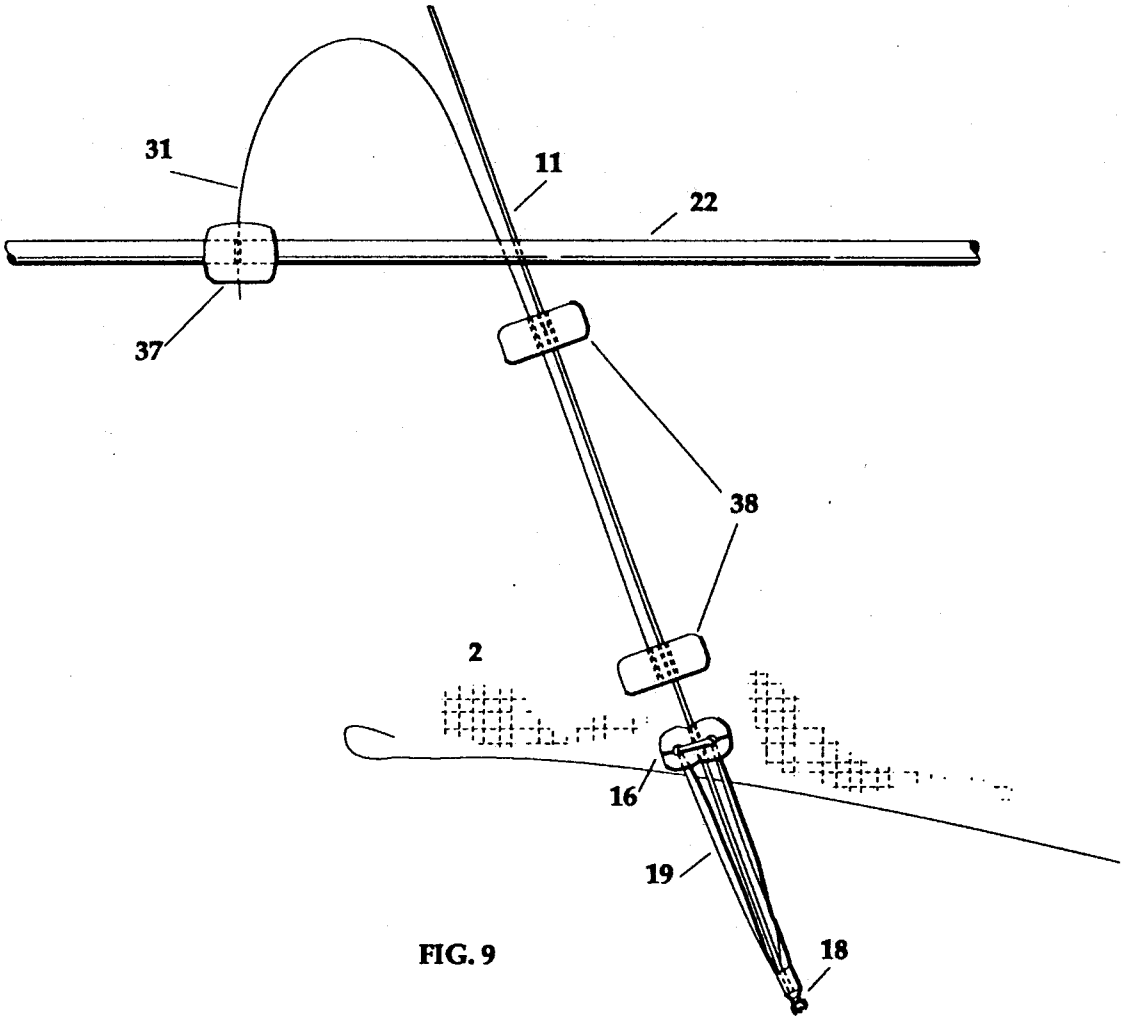
FIG. 9 shows batten attachment means of such kite, according to the invention.
Figure 9A:
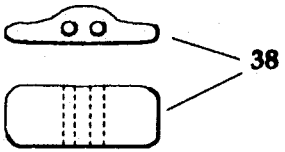
FIG. 9A shows fitting 38 of batten attachment means of such kite, according to the invention.
Figure 9B:
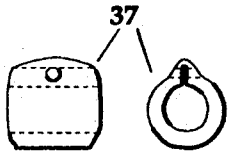
FIG. 9B shows fitting 37 of batten attachment means of such kite, according to the invention.
Figure 9C:
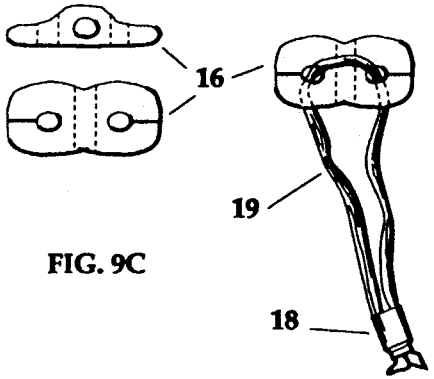
FIG. 9C shows fitting 16 and rubber bad 19 of such kite, according to the invention.

Nose 6 of kite 30 is shown in detail in FIG. 8. Nose 6 is preferably composed of a small metal rod and is inserted into tubular diagonal rods 7. In other embodiments, the shape of nose 6 may be altered to achieve different balance and weight characteristics of kite 30, or to add various ornamental characteristics.

In FIGS. 9, 9A, 9B, and 9C, the preferred attachment of battens 11 and 14 are illustrated. Preferably a small plastic fitting 16 is secured to sail 2 with one end of batten rod 11 inserted into tube 10 of first perpendicular rod 8 and into aperture 15 of connector 13. The other end of batten rod 11 or 14 is inserted into metal tube 18 attached at end of rubber band 19. Standoff rod 31 with fittings 37 and 38 is shown positioned and secured between second perpendicular rod 22 and batten rod 11 so that sail 2 is tensioned in flight. By sliding standoff rod 31 and fittings 38 on batten rod 11 further kite said control and kite speed control is achieved. For example, if fitting 38 and standoff rod 31 are positioned closer to nose 6 the curvature of batten rod 11 and sail 2 will increase which slows down kite speed in flight. Sail 2 is pulled by rubber band 19, which may, in alternative embodiments be a cord, string, bungee device, or the like. Aperture 15 is configured to provide space to secure the batten rod yet allow free movement thereof within the aperture.

Figure 10:
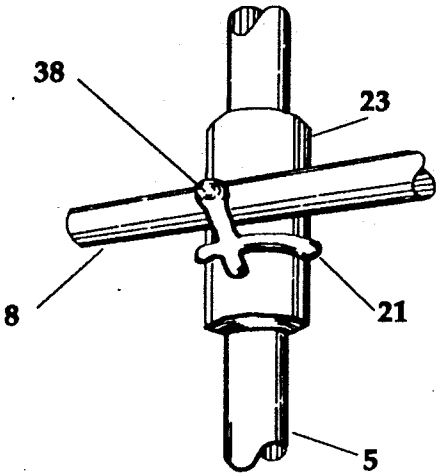
FIG. 10 shows a detail view of connector 21 on central rod 5, according to the invention.

In reference now to FIG. 10, a detailed view of connector 21 which supports the attachment of central rod 5 and first perpendicular rod 8 is shown. In this embodiment a connector 21 is ring shaped and preferably composed of metal, with a claw configured bar 38 secured thereto. Rod 5 is protected from abrasion or scratching from ring 21 by cushion 23 which may be composed of foam, rubber, vinyl, or the like. Connector 21 is adjustable by sliding either up or down rod 5. By altering the positioning of connector 21 different flight maneuverability characteristics of kite 30 may be obtained.

Figure 11:
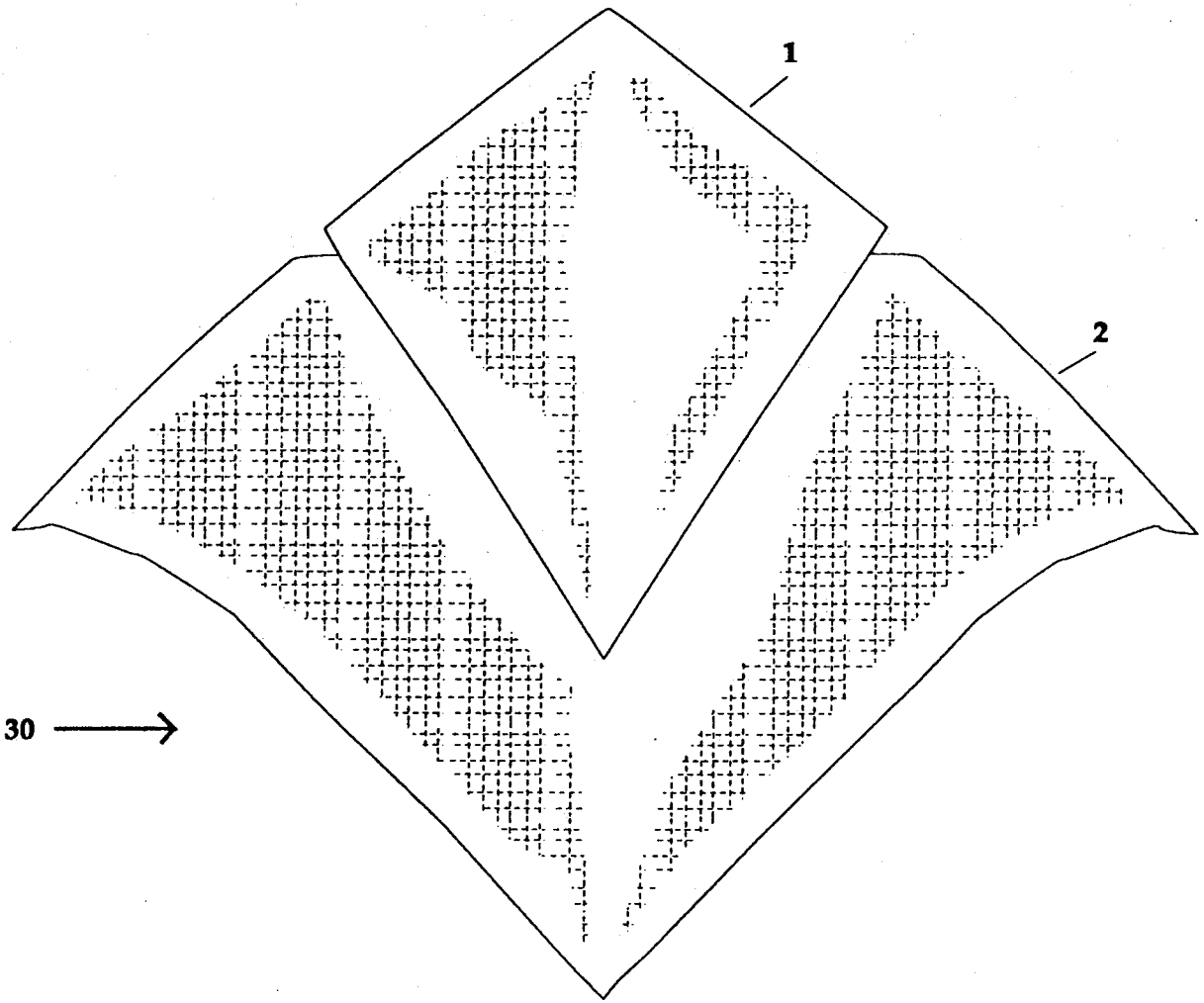
FIG. 11 shows a back view of such kite to illustrate a sail configuration of one embodiment of the invention.

FIG. 11 shows a rear schematic view of kite 30 with a preferred configuration of sails 1 and 2. However, the shape of the two sails may be varied, with shapes between the delta and diamond shape being preferred. A wide range of sail spans may be utilized, with approximately an eight to ten foot sail span being preferred. Kite 30 is easy to assembly and disassemble, inexpensive to manufacture, and provides for far greater flight characteristics than known kites.

While the above description contains many specificities such should not be construed as limitations on the scope of the invention, but merely as exemplifications of preferred embodiments thereof. Additional advantages and modifications will readily occur to those skilled in the art. The invention in its broader aspects is, therefire, not limited to the specific details, representative apparatus and illustrative examples shown and described. Accordingly, the scope of the invention and inventive concept should be determined by the scope of the claims and their legal equivalents, and not be limited by the specific examples which have been given.

I claim:

1. A sports kite for flying in variable winds, comprising:

a substantially delta-shaped frame including a central rod secured to a pair of diagonal frame members, said central rod having a front side and a rear side, a first sail of flexible durable material secured to said frame having a tail section and a wing tip section, a first perpendicular rod and a second perpendicular rod secured to said central rod, said first and said second perpendicular rod each having a plurality of adjustable batten rods secured thereto and to said sail by mechanical fastening means, and a second sail positioned in back of said first sail and secured to said rear side of said central rod by connecting means.

2. A two-stringed sport kite, comprising:

a delta-shaped frame having a central rod detachably secured to a pair of diagonal frame members, said central rod having a front side and a rear side, a first sail of durable, flexible, and resilient material secured to said frame, said first sail having a tail section and a wing tip section, a first and a second perpendicular rod each secured to said central rod, said first and said second perpendicular rods each having a plurality of adjustable batten rods operably attached thereto and to said first sail by connector means, and a second sail positioned in back of said first sail by attachment to said rear side of said central rod.

* * * * *